US007029170B2

(12) United States Patent
Bailey

(10) Patent No.: US 7,029,170 B2
(45) Date of Patent: Apr. 18, 2006

(54) SWIM LAP COUNTER/TIMER

(76) Inventor: Brad Bailey, 2601 26th St., Lubbock, TX (US) 79410

( * ) Notice: Subject to any disclaimer, the term of this patent is extended or adjusted under 35 U.S.C. 154(b) by 26 days.

(21) Appl. No.: 10/835,557

(22) Filed: Apr. 30, 2004

(65) Prior Publication Data

US 2005/0243651 A1 Nov. 3, 2005

(51) Int. Cl.
*G04B 37/00* (2006.01)

(52) U.S. Cl. ..... 368/276; 368/89; 340/323 R

(58) Field of Classification Search ..... 368/10, 368/276, 47, 89, 107; 340/323 R, 815.4; 377/24.2, 5; 73/861.77; D10/97
See application file for complete search history.

(56) References Cited

U.S. PATENT DOCUMENTS

| | | | | |
|---|---|---|---|---|
| 3,944,763 | A * | 3/1976 | Beierwaltes | 200/52 R |
| 4,518,266 | A | 5/1985 | Dawley | |
| 4,700,369 | A | 10/1987 | Siegal et al. | |
| 5,285,428 | A | 2/1994 | Roscow et al. | |
| 5,349,569 | A | 9/1994 | Tanaka | |
| 6,870,466 | B1 * | 3/2005 | Rust et al. | 340/323 R |

* cited by examiner

*Primary Examiner*—Kamand Cuneo
*Assistant Examiner*—Jeanne-Marguerite Goodwin
(74) *Attorney, Agent, or Firm*—Richard C. Litman

(57) ABSTRACT

The swim lap counter comprises a top section and a bottom section. In one aspect of the invention, the bottom section is suspended from the top section and comprises a pressure sensitive panel and a submersible digital display. The submersible digital display is disposed proximate the bottom edge of the bottom section.

19 Claims, 7 Drawing Sheets

SWIM LAP COUNTER/TIMER

BACKGROUND OF THE INVENTION

1. Field of the Invention

The present invention relates to swim lap counter-timers for swimmers and, more specifically, to a portable electronic lap counter and timer of the type having a touch panel for sensing swimmer arrival time.

2. Description of the Related Art

Lap swimmers universally experience a problem remembering how many laps they have swum, especially while in the process of completing longer sets. Also representing a problem to swimmers, is the ability to ascertain the running time of a swim effort while performing the specific technicalities of a swim stroke, as well as obtaining split-times for individual laps in a set, or accurate total completion times. Aside from depending on assistance from another person, devices are available for swimmers to record such times themselves; however, those require swimmers to interrupt very technical swim-stroke maneuvers to press tiny buttons. Even then, this information is not available to the swimmer while performing a set without pausing or severely interrupting stroke mechanics to look at a wrist or finger-mounted recording device.

Other devices remain at one end of the pool and sense arrival of the swimmer by contact with a touch or kick panel. For example, U.S. Pat. No. 5,349,569, issued September 20 to Tanaka, shows an electronic system for measuring swim time of a plurality of swimmers in competition. This system is not suitable for practice and does not provide immediate feedback to the swimmer.

U.S. Pat. No. 5,285,428, issued Feb. 8, 1994 to Rosow et al., discloses a lap timer that remains at one end of the pool and includes a display just above the water surface attached to a piezoelectric touch pad that extends below the water surface to detect swimmer arrival, e.g., by sensing a kick-turn, or flip-turn, or the swimmer's touch. This device utilizes a bendable bracket to temporarily mount the device in cooperation with various pool configurations. The problem with using a bendable bracket is that it ultimately fails due to metal fatigue when trying to bend the bracket to accommodate different pool configurations. Furthermore, the position of the counter display above the water requires that the swimmer lift his or her head out of the water to view the display, which interrupts the swimmer's movements.

U.S. Pat. No. 4,700,369, issued to Siegal et al. on Oct. 13, 1987, describes a pool lap counter having a small touch pad. The unit is laid flat on the pool deck with the display and a small touch pad positioned at the pool's edge. Use of this unit would interfere with a swimmer's movements and the display is not visible to the swimmer while he or she is swimming.

U.S. Pat. No. 4,518,266, issued to Dawley on May 21, 1985, describes a lap counter and timer having a display and kick-pad housed in a rigid housing which is hung over the side of a pool. The display is positioned over the water surface while the kickpad is just beneath the water surface. The unit cannot accommodate a significant pool deck overhang and the display above the water surface is inconvenient for the swimmer.

U.S. Pat. No. 3,944,763 issued Mar. 16, 1976 to Bejerwaltes, discloses a pressure sensitive pad for connection to a timing and indicating device for counting and timing swim laps. No particulars are mentioned with regard to the timing and display device. The pressure sensitive pad is hung on the gutter of a swimming pool wall. It is not suitable for, or readily adapted to, other pool configurations.

None of the above inventions and patents, taken either singly or in combination, is seen to describe the instant invention as claimed. Thus a lap swimming counter solving the aforementioned problems is desired.

SUMMARY OF THE INVENTION

The swim lap counter comprises a top section and a bottom section. In one aspect of the invention, the bottom section is suspended from the top section and comprises a pressure sensitive panel and a submersible digital display. The submersible digital display is disposed proximate the bottom edge of the bottom section.

The advantages of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
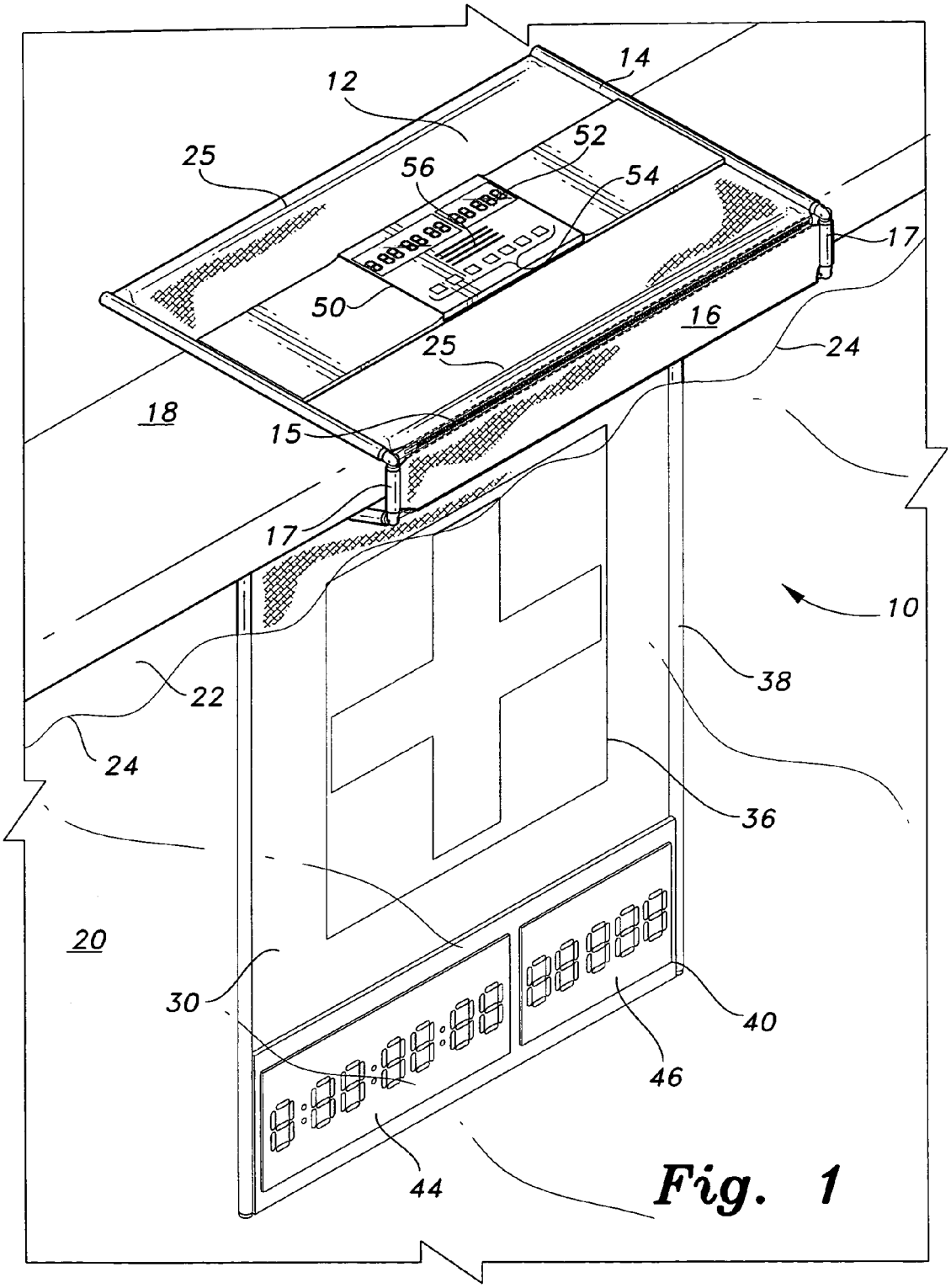
FIG. 1 is an environmental, perspective view of an exemplary swim lap counter-timer.

A swim lap counter-timer is shown generally at 10 in FIG. 1. This device has structural aspects, electronic aspects, and functional aspects. Each will be described in sequence below.

Structure

FIG. 1 shows an exemplary swim lap counter-timer including a top section 12 having an electronic control unit 50 and a bottom section 30 having at least one pressure sensitive panel and a digital display 40. Each section comprises a flexible mat. As will be further described below, top section 12 and bottom section 30 may be connected directly together, or one or more intermediate spacer sections 16 may be connected between top section 12 and bottom section 30 for the purpose of adapting swim lap counter-timer 10 to a specific swimming pool configuration. Each connection is connected to adjacent sections with a zipper joint 15. Other methods of connecting sections, including snaps, hooks, buttons, or hook-and-loop fasteners, such as that sold under the trademark "Velcro", are contemplated.

Figure 2:
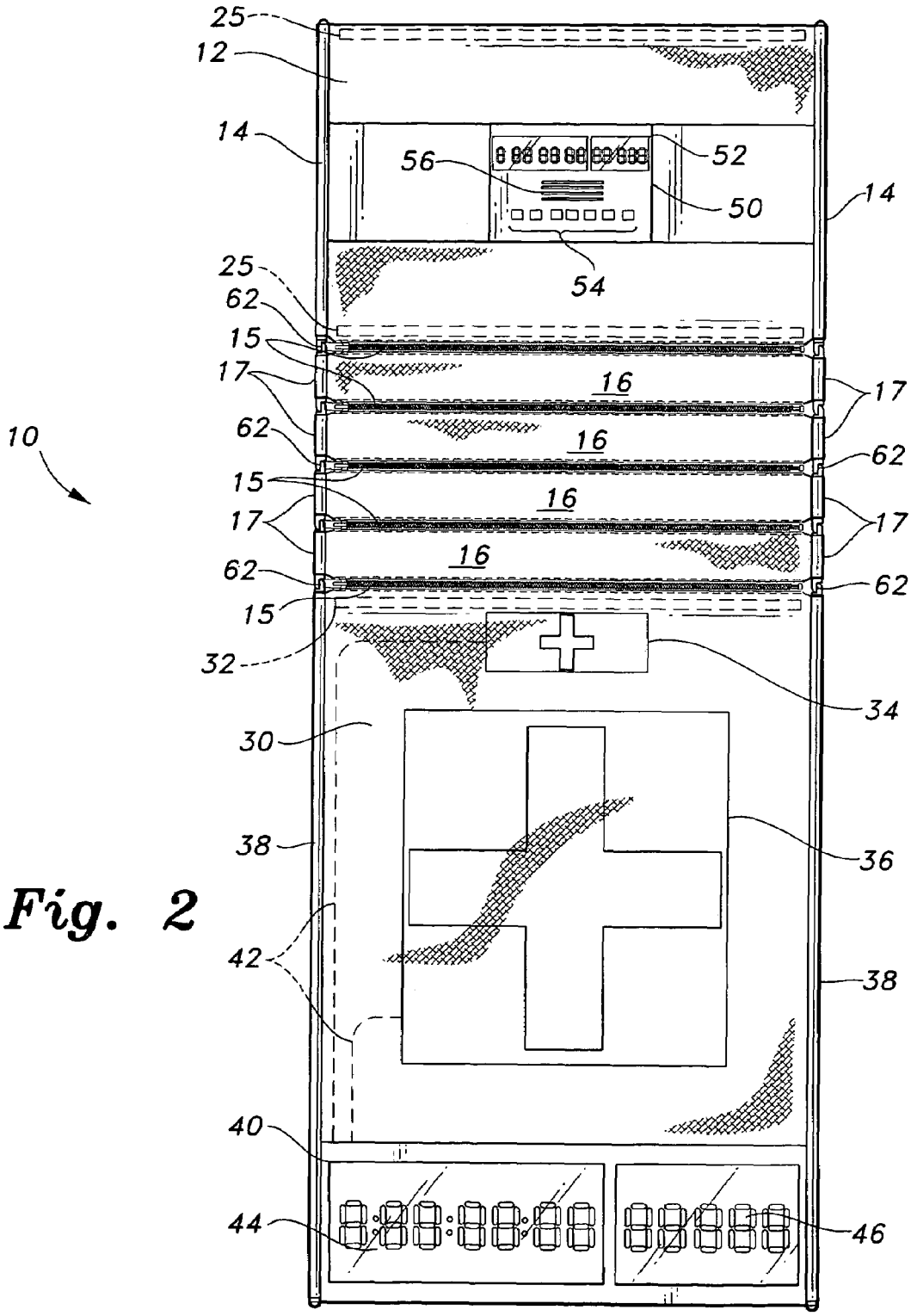
FIG. 2 is a plan view of the swim lap counter-timer of FIG. 1 when laid flat.

Referring now to FIGS. 1 and 2, top section 12 comprises a substantially flat flexible vinyl mat having a molded socket for retaining a control unit 50. Other means of retaining control unit 50, such as hook-and-loop fasteners, snaps, straps, and/or a sealable transparent plastic pocket are contemplated. Control unit 50 may be attached to top section 12 facing either towards the pool or away from the pool. Top section 12 may also be formed of other materials such as woven fabric or other plastics. Top section 12 is sized sufficiently to provide support for the remainder of swim lap counter timer 10 and to retain control unit 40. For example, top section 12 may be about 24 inches (61 cm) wide, excluding top sleeves 14 and about 16 inches (41 cm) deep.

If necessary, embedded lateral support rods 25 are provided to improve lateral rigidity of top section 12. Embedded lateral support rods 25 extend transversely at upper and lower edges of top section 12 and may be, for example, rigid plastic, fiberglass or aluminum rods of about one-half inch (1.3 cm) diameter. In place of distinct embedded lateral support rods 25, a thickened portion of top section 12 may be molded into top section 12 as an integral embedded support rod. By "rigid," it is meant that embedded lateral support rods 25 are sufficiently rigid to maintain top section 12 substantially flat in the transverse direction, i.e., to keep the left and right edges separated.

Bottom section 30 comprises a substantially flat flexible vinyl mat comprising two pressure sensitive panels 34, 35, and a digital display 40. Along the upper edge of bottom section 30 is a zipper for connecting to the bottom edge of top section 12 or the bottom edge of a spacer section 16. Extending transversely adjacent the upper edge of bottom section 30 is an embedded lateral support rod 32 that operates in a manner similar to embedded lateral support rods 25 of top section 12 described above. Embedded lateral support rod 32 may also be formed integrally with bottom section 30 as described above with respect to top section 12.

A first pressure sensitive finish panel 34 is positioned near an upper edge of bottom section 30 and is intended to be placed mostly above water surface 24 (FIG. 1). A second pressure-sensitive panel, hereinafter referred to as flip-turn panel 36, is in a central portion of bottom section 30. The first and second pressure sensitive panels are flexible and integrated into the vinyl mat for sensing the arrival by touch or flip-turn of a swimmer. Finally, a large illuminated digital display 40 is provided at the bottom of bottom section 30. Digital display 40 provides at least a counter display 46 showing the current lap number or laps to go, or lap distance in meters or yards swam to the swimmer. As shown, digital display 40 also provides a count-up or count-down timer display 44. Digital display 40 is preferably an illuminated LCD display; however other display types such as LED displays are contemplated.

Bottom section 30 must be large enough to accommodate the integrated components mentioned above. For example, bottom section 30 may be 24 inches (61 cm) wide (not including bottom sleeves 38) and 36 inches (91 cm) deep to accommodate a 3 inch (8 cm) by 8 inch (20 cm) finish panel 34, a 16 inch (41 cm) wide by 18 inch tall (46 cm) flip-turn panel 36, and an 8 inch (20 cm) tall digital display with a 6 inch (15 cm) tall LCD screen.

Between top section 12 and bottom section 30, there may be any number of spacer sections 16 to provide the desired distance between top section 12 and bottom section 30, which may vary depending upon the configuration of pool edge 22 and distance from pool deck 18 to water surface 24. Spacer sections 16 may be provided with varying distances or all the same small length, e.g., 3 inches (8 cm) tall.

Along the left and right edges of top section 12 are top sleeves 14, which are closed at an upper end with reinforced capped ends. Along the left and right edges of spacer sections 16 are sleeves 17 aligned with top sleeves 14. Sleeves 17 are open at their upper and lower ends. Likewise, along left and right edges of bottom section 30 are bottom sleeves 38 that are closed at their bottom ends with reinforced capped ends. Top sleeves 14, spacer sleeves 17, and bottom sleeves 38 are aligned when swim lap counter-timer is laid flat as shown in FIG. 2.

Within top, spacer, and bottom sleeves 14, 17, and 38, a configurable support rod 60 extends to maintain top and bottom sections flat in the vertical direction. A locking elbow joint 62 connects adjacent longitudinal support rods to provide an adjustable support frame so that swim lap counter-timer 10 can be configured to conform to the pool edge of any swimming pool.

Figure 3:
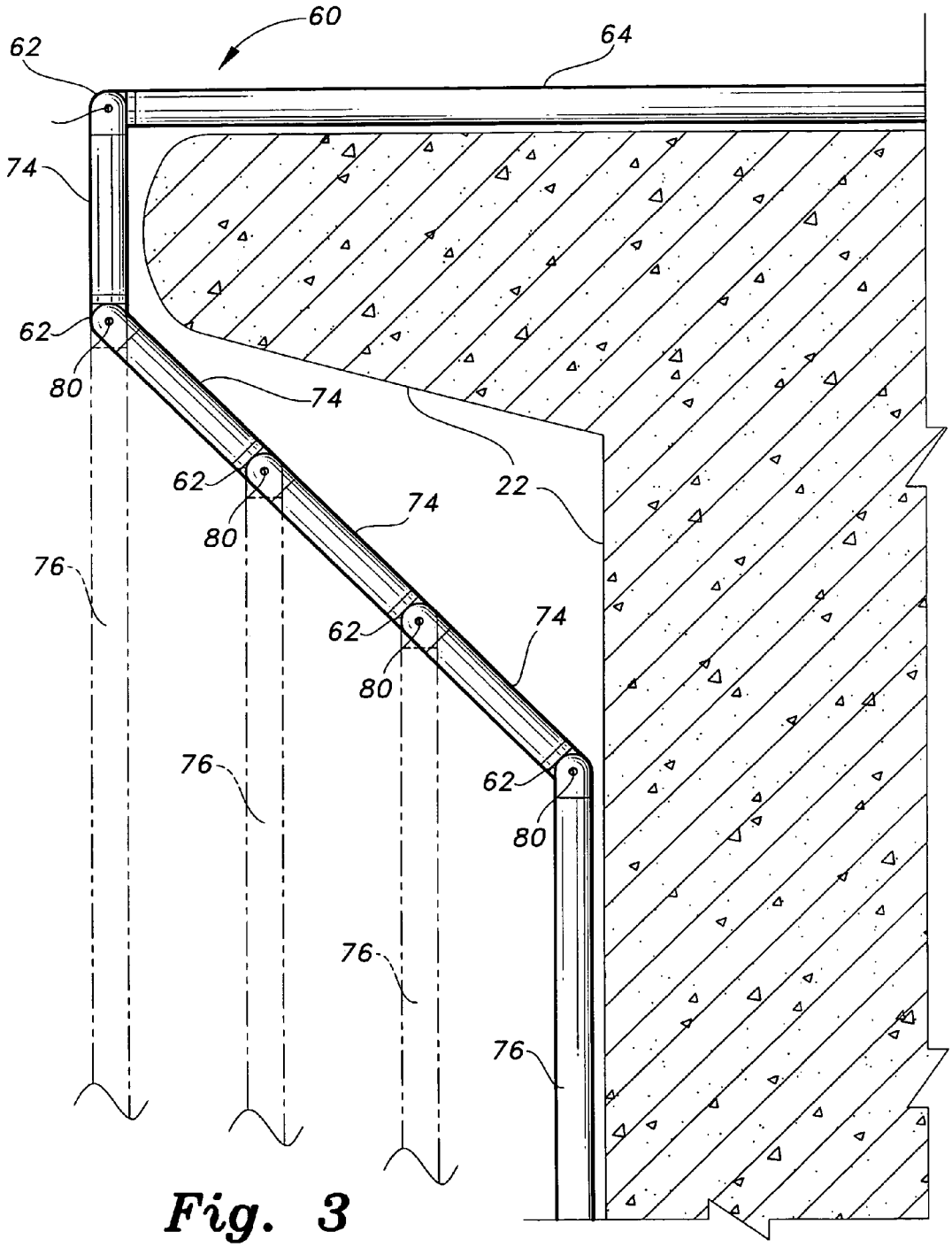
FIG. 3 is a profile, section view of a pool edge/lip with exemplary swim pad longitudinal support rods in conformance therewith.
Figure 3A:
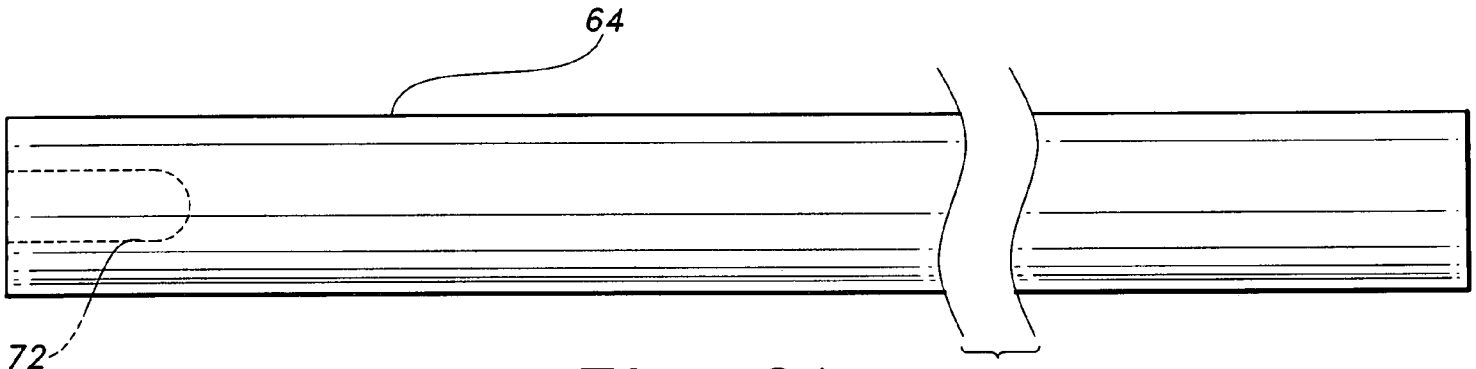
FIG. 3A is a top section support rod.

Support rod 60 is shown in a profile view in FIG. 3 without swim lap counter-timer 10 and comprises a top longitudinal support rod 64, a bottom longitudinal support rod 76, and a number of spacer support rods 74. FIG. 3A shows top longitudinal support rod 64 having one end with an axial hole 72 formed therein. FIGS. 3E and 3F show bottom longitudinal support rod 76 and spacer support rods 74, respectively.

Bottom longitudinal support rod 76, shown in FIG. 3E, comprises 3 12-inch (30 cm) sections with an elastic shock-cord 78 passing through them. Each section has a narrowed end for inserting into the opening end of the next section. Elastic shock cord 78 ensures correct assembly and keeps parts of the longitudinal support rod together when collapsed. Bottom longitudinal support rod 76 is thus collapsible into parts that are easily reconnected to form a rigid longitudinal support rod. Longitudinal support rods may be formed of aluminum, plastic, composite, and/or other substantially rigid materials.

Figure 3B:
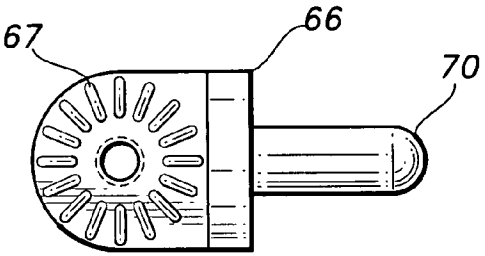
FIG. 3B shows a male angle-connector having radial ridges.
Figure 3C:
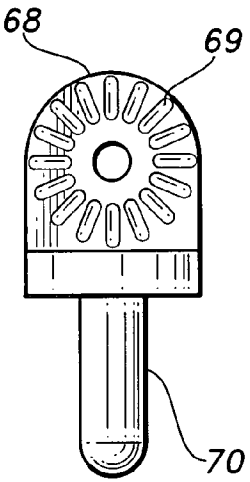
FIG. 3C shows a female angle-connector having radial grooves.
Figure 3D:
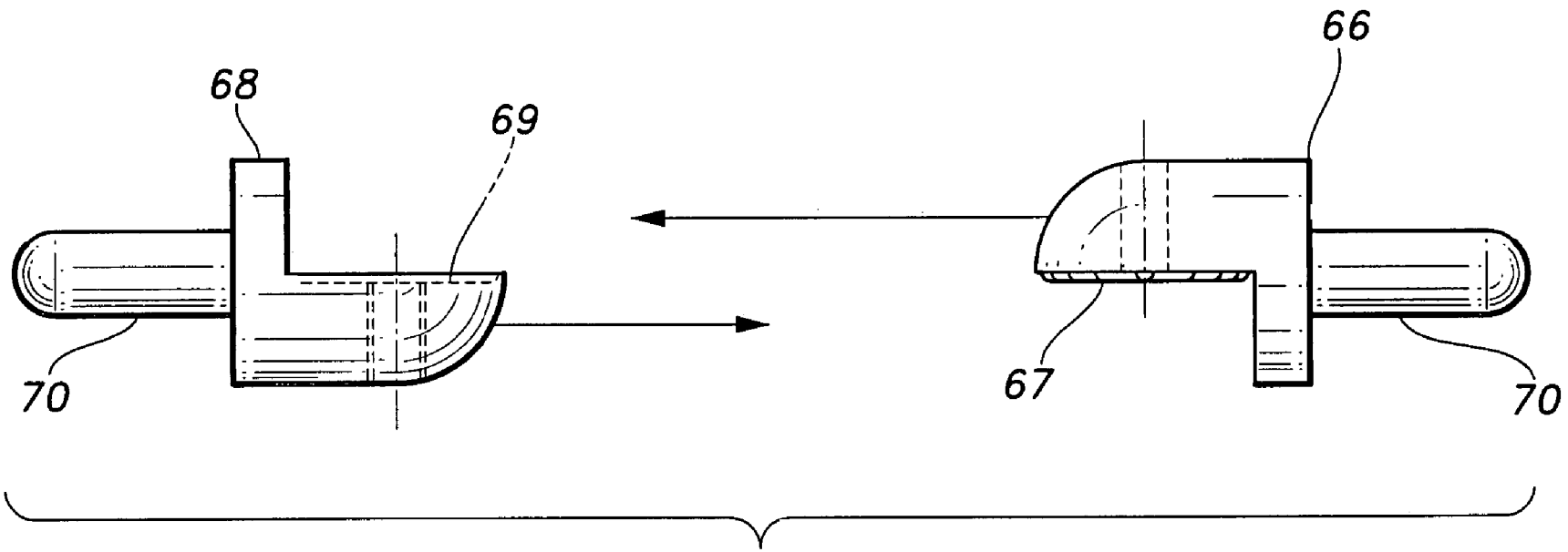
FIG. 3D is a profile view of male and female connectors of FIGS. 3B and 3C.
Figure 3E:
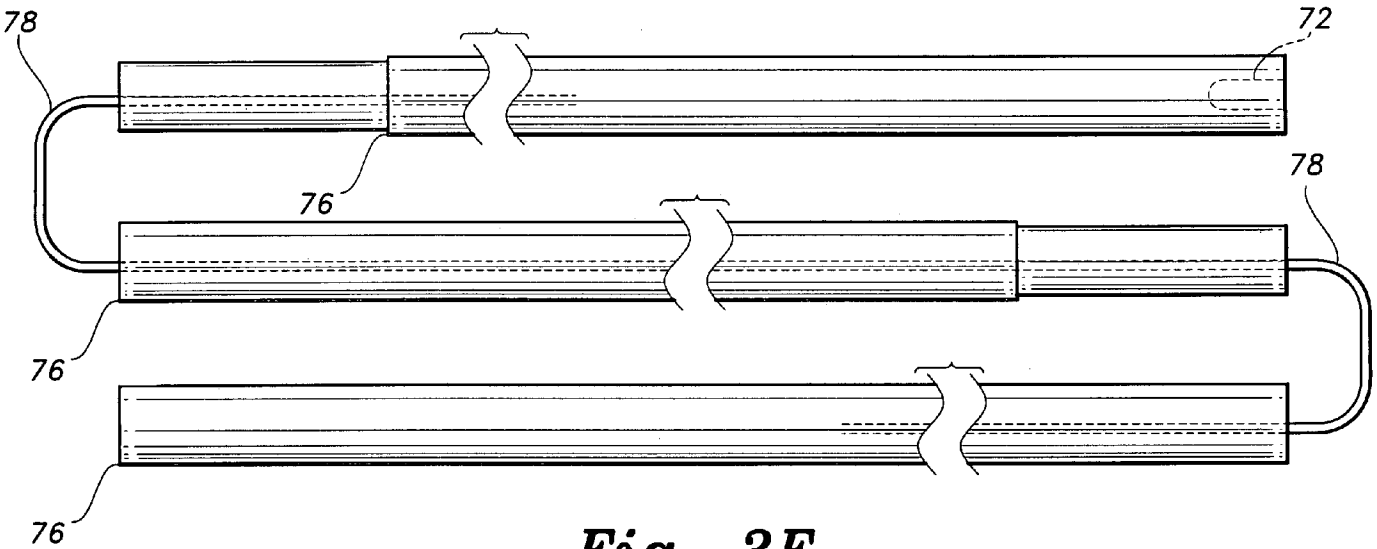
FIG. 3E is a plan view of a collapsible longitudinal support rod for lending rigidity to the bottom section of the exemplary swim lap counter-timer.
Figure 3F:
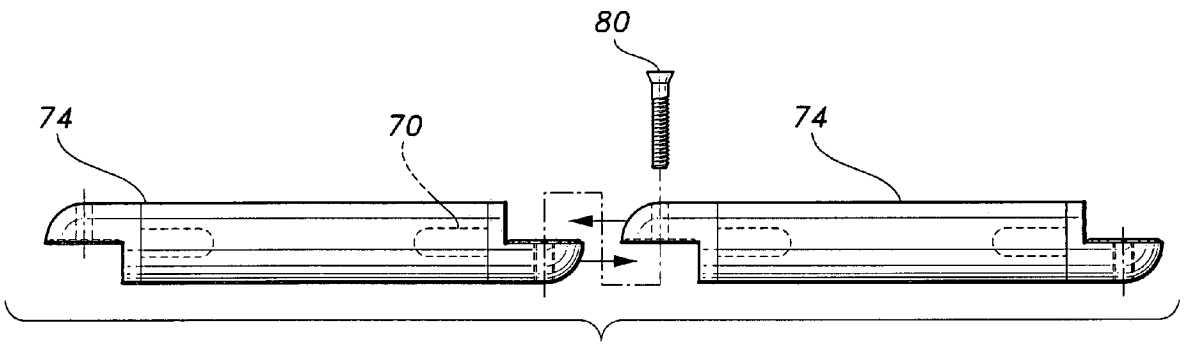
FIG. 3F is an exploded view of spacer support rods.

Referring back to FIG. 3, each longitudinal support rod is connected to its neighbor by a locking elbow joint 62, shown in FIGS. 3B, 3C, and 3D. FIG. 3B shows male half 66 of elbow joint 62 comprising at one end a dowel 70 that fits snugly into hole 72 formed into the ends of longitudinal support rods 64, 74, 76. At the other end of male half 66 of elbow joint 62 is a circular face arranged transversely and comprising a plurality of ridges 67 extending radially.

Female half 68 is similar in construction to male half 66 described above, but includes grooves 69 designed to cooperate with ridges formed into male half 66 of locking elbow joint 62. A screw 80 (FIG. 3F) holds ridges 67 and grooves 69 into engagement with dowels 70 of male half 66 and female half 68 extending at a selected angle with respect to one another.

Locking elbow joints 62 thereby provide a means for maintaining the sections of swim lap counter-timer at a user-defined selected angle with respect to one another. Returning to FIG. 3, top longitudinal support rod 64 is thereby connected at a right angle to a spacer support rod 74 via a first locking elbow joint 62. Successive spacer support rods 74 are connected in series and are placed at a 45° angle to the first spacer support rod 74. Finally, a bottom longitudinal support rod 76 is attached to the bottom of the last spacer support rod 74, at a 45° angle such that it hangs vertically. Shown in phantom are exemplary alternative positions of bottom longitudinal support rod 76 in place of successive spacer support rods 74. These alternative positions would be used for a pool edge 22 having a smaller overhang than the exemplary pool edge 22 shown in FIG. 3.

As shown in FIG. 3B and 3C, male half 66 and female half 68 of locking elbow joint 62 has 16 different angular positions, thereby permitting locking elbow joint 62 to fix an angle every 22.5 degrees. However, it is contemplated that any number of angular positions may be accommodated, and other cooperating shapes besides ridges and grooves may be utilized as would occur to a person skilled in the art.

The unit is assembled by inserting top longitudinal support rods 64 into left and right top sleeves 14 of top section 12, inserting bottom longitudinal support rods 76 into left and right bottom sleeves 38, inserting spacer support rods 74 into spacer sleeves 17 of any spacer sections 16 that are necessary for use with the configuration of pool edge 22. Then, locking elbow joints 62 are configured to the desired angles for connecting the various longitudinal support rods together so that swim lap counter-timer 10 takes on the desired shape. Dowels 70 of locking elbow joints 62 are inserted into holes 72 (FIG. 3A, 3E) formed axially into the ends of longitudinal support rods 64, 74, 76. The sections are then zippered together. The sections are of close tolerance to ensure a small amount of compression against the longitudinal support rods to hold dowels 70 in place within holes 72. In this way, flexible swim lap counter-timer can be held flat against the vertical wall of pool 20 regardless of the configuration of pool edge 22.

Configurable support rod 60 may be modified from the example shown and described above. For example, spacer support rods 74 may be integrally molded with male and female locking elbow joint halves, or may include just one half at one end and a hole 72 for a dowel at the other end. This will provide for easier assembly and fewer parts to keep track of when disassembled.

Electronics

Referring back now to FIGS. 1 and 2, control unit 50 comprises an electronic display 52 and input buttons 54. Control unit 50 is in communication with digital display 40 of bottom section 30. Pressure sensitive finish and flip turn panels 34, 36 are thin, flexible and have a conductivity that varies with the pressure applied thereagainst. Electronic display 52 includes the same information as on digital display 40 and may also include mode indicators to indicate various operational modes as will be described in further detail below.

The technology for providing pressure sensitive finish and flip turn panels 34, 36 is known. For example, Tekscan, Inc. of South Boston, Mass., has a proprietary pressure-sensitive ink containing semiconductive particles suspended in a polymer-based binder. The binder and multiple layers of silver are printed onto two thin, flexible polyester films, such as that sold under the trademark "MYLAR" by DuPont Corporation of Wilmington, Del. The resulting sandwich is 0.004 inches (1 mm) thick. The electrical resistance of this type of pressure sensitive panel reduces with increased pressure, which can therefore be measured by voltage drop or increase in current.

A threshold of amplitude and/or derivative of applied pressure is selected to filter out false positives so that wave action or other movement of the device will not be interpreted as the arrival of the swimmer. Embedded leads 42 extend from digital display 40 to panels 34, 36 thereby placing digital display 40 into electronic communication with panels 34, 36. Circuitry for measuring resistance and therefore pressure of finish panel 34 and flip turn panel 36 is provided in digital display 40.

Digital display 40 and control unit 50 are in electronic communication via a wireless connection. Alternatively, wire leads (not shown) may extend from display 40 to control unit 50 either externally of top, spacer, and bottom sections 12, 16, 30 or internally with commercially available waterproof connectors at each zipper joint 15. For the wireless connection, any available suitable wireless technology may be used such as, for example, the Bluetooth wireless specification promulgated by the trade association Bluetooth SIG of Overland Park, Kans.

One advantage of using wireless technology is that it is not affected by water. Another advantage is increased flexibility of use. For example, rather than operate as a solo practice or workout aid, the swim lap counter-timer can assist a coach, who can carry control unit 50 around with him or place multiple units on a table for monitoring the progress of multiple athletes. Secondly, the control units can be programmed link up wirelessly and give a starting signal via speaker 56 for a race among multiple athletes. The devices can then identify the winner after a preprogrammed number of laps without a human official.

In addition to electronic display 52, control unit 50 includes control buttons 56 including mode, select, set buttons for both the timer and lap counter, as well as a waterproof speaker 56.

Operation

After the device is assembled as described above and placed on the edge of a pool 20 as shown in FIG. 1, control unit 50 and digital display 40 are turned on. Control unit 50 will indicate that the units are communicating. If other units are within range or are otherwise in communication, they may be linked up and identified with a user-defined tag and a racing mode with be enabled with one of the units being designated the "master" unit and other units being designated "slave" units. The master unit will dictate the parameters of the race, initiate start count-down sequence, and determine the winner.

The user selects the timer and lap mode using mode input buttons 54. The timer can be in count-up mode or count-down mode to count down from a selected starting value. The counter display 46 can be configured to show laps, meters or yards swam, with the yards or meter function configured with a selected number of meters or yards per lap. The user can select a count-down mode wherein the counter can display distance to go (in laps, meters, or yards) or a count-up mode to display distance swam.

Once the desired timing and counting modes are selected, the user can press a start button which initiates a count down sequence. The count down sequence can be a series of beeps to indicate a start time, or else, a synthesized voice will declare the starting time via speaker 56 (FIG. 2). At the end of each lap, the user will either kick flip-turn panel 36 in the course of executing a flip-turn, or touch the finish panel 34 to indicate to control unit 50 that the swimmer is finished swimming. Control unit 50 stores each lap time, and these can be viewed using input buttons 54.

Racing statistics stored in control unit 50 can be downloaded to a general purpose personal computer (not shown) via standard communication ports such as a USB port. In addition, a personal computer can be linked to control unit 50 wirelessly or otherwise to display real-time information.

Figure 4:
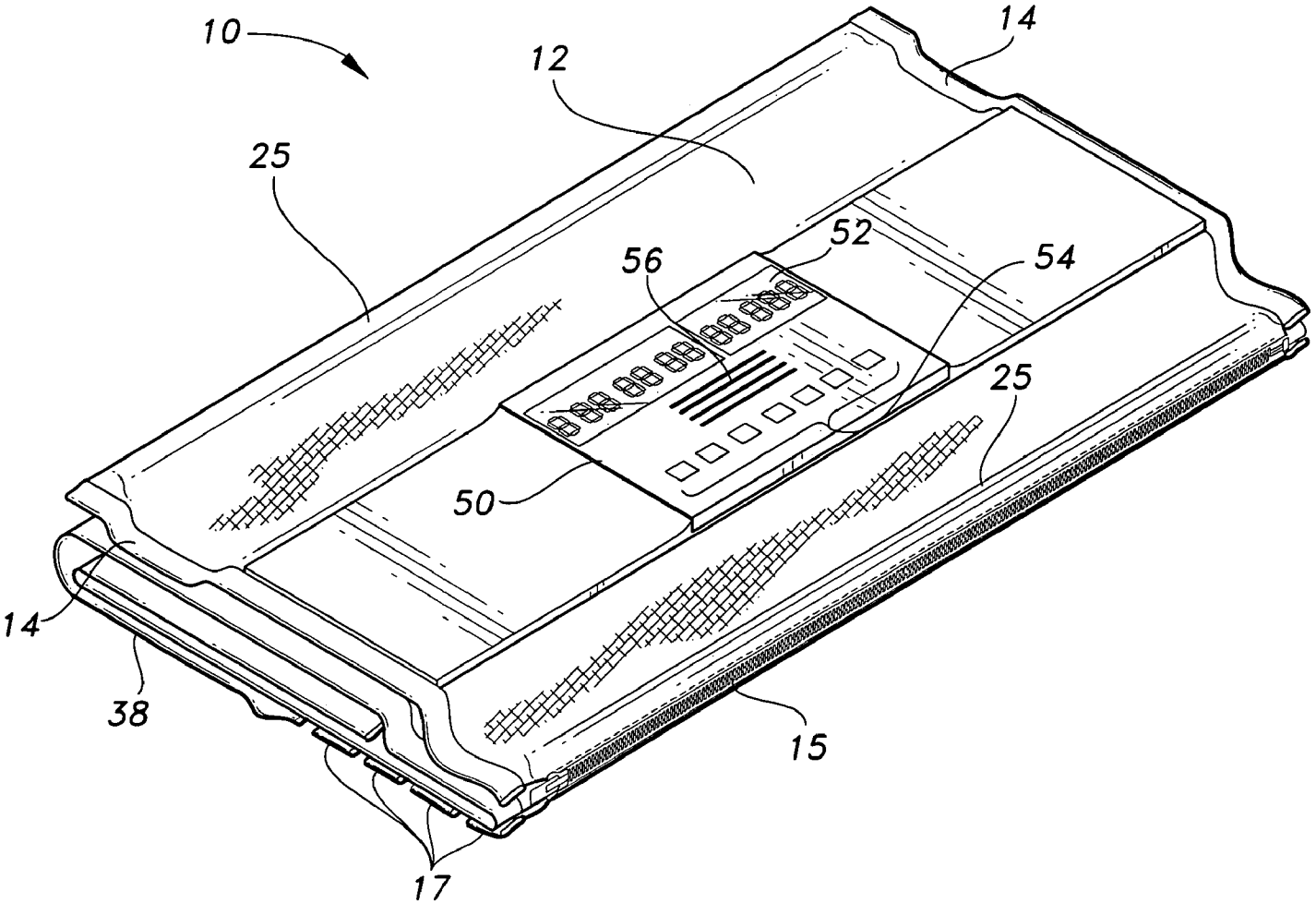
FIG. 4 shows the swim lap counter-timer of FIGS. 1 and 2 rolled up for storage.

When the unit is to be stored, zipper-joints 15 are unzipped thereby releasing each section from its neighbors and longitudinal support rods 64, 74, 76 are removed from respective sleeves 14, 17, and 38. Sections may then be re-zipped together and the entire assembly rolled up as shown in FIG. 4. Bottom longitudinal support rods 76 can be collapsed as shown in FIG. 3E, and they, along with the other longitudinal support rods may then be placed in a bag (not shown) along with rolled-up swim lap counter timer 10.

It is to be understood that the present invention is not limited to the embodiment described above, but encompasses any and all embodiments within the scope of the following claims.

I claim:

1. A swim lap counter comprising:

atop section formed of a flexible material, said top section including a top edge, a bottom edge, a left edge and a right edge with a sleeve formed along the left and right edges of the top section;

a bottom section formed of a flexible materials and suspended from the top section, said bottom section including a top edge, a bottom edge, a left edge and a right edge with a sleeve formed along the left and right edges of the bottom section;

a lateral support rod transversely extending along the top edge of said top section and the top edge of said bottom to provide lateral rigidity to the top and bottom sections;

longitudinal support rods passing through each said sleeve formed along the left and right edges of said top section, and adjacent longitudinal support rods passing through each said sleeve formed along the left and right edges of said bottom section, wherein each of said adjacent support rods of the bottom section are connected to each of said support rods of the top section by a locking elbow joint;

said bottom section comprising a pressure sensitive panel and a submersible digital display, said submersible digital display being disposed proximate the bottom edge of said bottom section.

2. The swim lap counter of claim 1, wherein said top section and said bottom section are formed of flexible mats.

3. The swim lap counter of claim 2 wherein said flexible mats comprise vinyl.

4. The swim lap counter of claim 1 wherein said top section includes a first part of a connector at the bottom edge and said bottom section includes a second part of said connector at the top edge, said first part and said second part being connectible together.

5. The swim lap counter of claim 4 wherein said connector is a zipper.

6. The swim lap counter of claim 4 wherein a predetermined number of spacer sections having cooperating connector parts are connected in series between said top section and said bottom section using said first and said second parts of said connector.

7. The swim lap counter of claim 6 wherein said connector is a zipper connection and said spacer sections include zipper connections at top and bottom edges thereof such that they may be connected in series between the top section and the bottom section.

8. The swim lap counter of claim 1 wherein said first pressure sensitive panel is a finish panel positioned near the top edge of said bottom section, said bottom section further comprising a second pressure sensitive panel sized and positioned below said first pressure sensitive panel for contact with the feet of a swimmer upon executing a flip-turn.

9. The swim lap counter of claim 1 further comprising a control unit in electronic communication with said digital display and said pressure sensitive panel; said control unit including an electronic display and at least one input button.

10. The swim lap counter of claim 9 wherein said top section includes a recess for removably retaining said control unit.

11. The swim lap counter of claim 9 wherein said electronic communication is a wireless electronic communication.

12. The swim lap counter of claim 9 further comprising a timer mechanism, said digital display and said electronic display including a timer display.

13. The swim lap counter of claim 9 wherein said control unit includes additional communication capability and is programmed to electronically communicate with other swim lap counters to start and declare the winner of a multi-lap swimming race.

14. The swim lap counter of claim 9 wherein said control unit stores lap time data and includes a communication port and programming for passing said lap time data to a general purpose computer.

15. A swim lap counter comprising:

atop section formed of a flexible material, said top section including atop edge, a bottom edge, a left edge and a right edge with a sleeve formed along the left and right edges of the top section;

a bottom section formed of a flexible materials and suspended from the top section, said bottom section including a top edge, a bottom edge, a left edge and a right edge with a sleeve formed along the left and right edges of the bottom section;

a lateral support rod transversely extending along the top edge of said top section and the top edge of said bottom to provide lateral rigidity to the top and bottom sections;

longitudinal support rods passing through each said sleeve formed along the left and right edges of said top section, and adjacent longitudinal support rods passing through each said sleeve formed along the left and right edges of said bottom section, wherein each of said adjacent support rods of the bottom section are connected to each of said support rods of the top section by a locking elbow joint;

said bottom section comprising a pressure sensitive panel; and a control unit in wireless electronic communication with said pressure sensitive panel.

16. The swim lap counter of claim 15 wherein said top section includes a recess for removably retaining said control unit.

17. The swim lap counter of claim 15, said bottom section further comprising a digital display, said control unit also being in wireless electronic communication with said digital display.

18. A swim lap counter comprising:

a top section formed of a flexible material, said ton section including a top edge, a bottom edge, a left edge and a right edge with a sleeve formed along the left and right edges, said top section having a first part of a connector at the bottom edge;

a bottom section formed of a flexible materials and suspended from the top sections, said bottom section including a top edge, a bottom edge, a left edge and a right edge with a sleeve formed along the left and right edges of the bottom section;

a lateral support rod transversely extending along the top edge of said top section and the top edge of said bottom to provide lateral rigidity to the top and bottom sections;

longitudinal support rods passing through each said sleeve formed along the left and right edges of said top section, and adjacent longitudinal support rods passing through each said sleeve formed along the left and right edges of said bottom section, wherein each of said adjacent support rods of the bottom section are connected to each of said support rods of the top section by a locking elbow joint;

said bottom section comprising a pressure sensitive panel for detecting an arrival of a swimmer thereat, said bottom section further comprising a second part of said connector at the top edge thereof, said second part of said connector being connectible to said first part of said connector such that said top section and said bottom section are connected directly to each other by said connector; and at least one spacer section having connector parts along a top and bottom edge thereof said spacer section being connectible between said top section and said bottom section such that said top section is connected to said bottom connection indirectly via said at least one spacer section.

19. The swim lap counter of claim 18 wherein said connector is a zipper connection and said spacer sections include zipper connections at top and bottom edges thereof such that they may be connected in series between the top section and the bottom section.

* * * * *